US007383847B2

(12) United States Patent
Clark

(10) Patent No.: US 7,383,847 B2
(45) Date of Patent: Jun. 10, 2008

(54) PAINT IMPLEMENTS CLEANING SYSTEM

(76) Inventor: Kevin Michael Clark, 1025 SE. 11th Ter. #A, Cape Coral, FL (US) 33990

( * ) Notice: Subject to any disclaimer, the term of this patent is extended or adjusted under 35 U.S.C. 154(b) by 148 days.

(21) Appl. No.: 11/373,672

(22) Filed: Mar. 13, 2006

(65) Prior Publication Data

US 2007/0089765 A1 Apr. 26, 2007

Related U.S. Application Data

(60) Provisional application No. 60/729,397, filed on Oct. 24, 2005.

(51) Int. Cl.
*B08B 3/02* (2006.01)

(52) U.S. Cl. ..... 134/148; 134/900

(58) Field of Classification Search ..... 134/900
See application file for complete search history.

(56) References Cited

U.S. PATENT DOCUMENTS 2,542,491 A * 2/1951 Engel ..... 69/19
3,085,583 A * 4/1963 Siek ..... 134/109
3,925,908 A * 12/1975 Dunn ..... 34/58
4,641,673 A * 2/1987 Conley et al. ..... 134/138
4,672,987 A * 6/1987 Brandt ..... 134/138
4,832,066 A * 5/1989 Shipman ..... 134/137
5,409,027 A * 4/1995 Glunt ..... 134/138
5,839,459 A * 11/1998 Bisby ..... 134/138
6,363,954 B2 * 4/2002 Bastien ..... 134/141
6,578,590 B2 * 6/2003 Leblond ..... 134/99.2

FOREIGN PATENT DOCUMENTS

DE 36 22 890 * 7/1986

* cited by examiner

*Primary Examiner*—Frankie L. Stinson
(74) *Attorney, Agent, or Firm*—Werner Schroeder

(57) ABSTRACT

A paint implement cleaning system consists of a basic container having at least three water pressure nozzles located therein. There is at least one at the bottom of the container and others are located midway within the container and diametrically opposite from each other. The basic container has a closure cap therein which suspends cleaning implements therefrom. One implement can be a paint laden paint brush which is cleaning by way of the nozzles located within the container. A paint roller can be rotatably supported on a threaded spindle which in turn is suspended from the closure cap. A jet pipe is located adjacent to the paint roller and has a multiple of nozzles thereon which direct pressurized water streams tangentially against the circumference of the paint roller to cause the paint roller to spin while being cleaned.

7 Claims, 2 Drawing Sheets

PAINT IMPLEMENTS CLEANING SYSTEM

REFERENCE TO PRIOR APPLICATIONS

This Application is a Continuation-In-Part of the Provisional Application No. 60/729,397 filed on Oct. 24, 2005.

FIELD OF THE INVENTION

The system is used to remove residual water soluble paint from brushes or rollers by using water. There are many prior art devices designed to clean paint brushes and/or paint rollers as is shown below:

BACKGROUND OF THE INVENTION

U.S. Pat. No. 3,577,280 shows a paint roller cleaner wherein the roller is suspended in a cylindrical container together with the roller handle and a tubular member has spray holes imparted therein that will spray water at the outer circumference of the paint roller at a tangent.

U.S. Pat. No. 3,688,785 illustrates a paint roller cleaner wherein two separate paint rollers are suspended in a container together with their handles which are used while painting. There are shown at least two rollers and they are of different diameters. Jet means are carried by an assembly on the container and the jets are directed against the periphery of each one of the rollers.

U.S. Pat. No. 4,708,152 discloses a cleaning device for a paint roller. In this device a paint roller is shoved over an existing roller holder and jet streams direct water against the periphery of the roller.

U.S. Pat. No. 4,809,722 illustrates a paint roller cleaner which is suspended within a container and water pressure is directed to the surface of the roller by a coiled tube that surrounds the roller and the cleaning water is applied through a multiple of orifices inside the coiled tube.

U.S. Pat. No. 4,912,797 discloses a paint brush cleaner wherein a multiple of brushes can be supported so that they are in contact with a rotating cleaner roller including high water pressure directed toward the brushes.

U.S. Pat. No. 5,107,877 shows a brush cleaning device wherein a brush holder is moved transversely back and forth to agitate the brushes while they are in cleaning fluid.

U.S. Pat. No. 5,839,459 discloses a paint roller cleaning apparatus which is a tubular container having the paint roller handle clamped therein and lateral jets impinge on the outer circumference of the paint roller.

U.S. Pat. No. 6,666,925 discloses a paint brush cleaner including a housing with an open top. A pair of rotatable radial brush brackets support the paint brushes in a central space. A number of upwardly spaced nozzles are directed toward the paint brushes.

U.S. Pat. No. 6,779,535 simple discloses a paint brush cleaning device in the form of a nozzle with a jet stream of cleaning fluid directed to an interior of the brush bristles.

U.S. Pat. No. D349,327 shows paint roller cleaner being placed in a container wherein jet streams are forced against the longitudinal length of the paint roller.

BRIEF DESCRIPTION OF THE INVENTION

The inventive paint brush/paint roller cleaner consists of a basic container wherein the paint implements to be cleaned are suspended while being cleaned under water pressure. The basic container has at least three water pressure nozzles coming in on many different directions. The paint implements to be cleaned are suspended from a common top closure cap when presented to the cleaning action. A paint brush is being suspended therefrom and a paint roller is suspended from a like closure cap by way of a spindle so that it can rotate when subjected to the cleaning action or procedure.

DETAILED DESCRIPTION OF THE INVENTION

Figure 1:
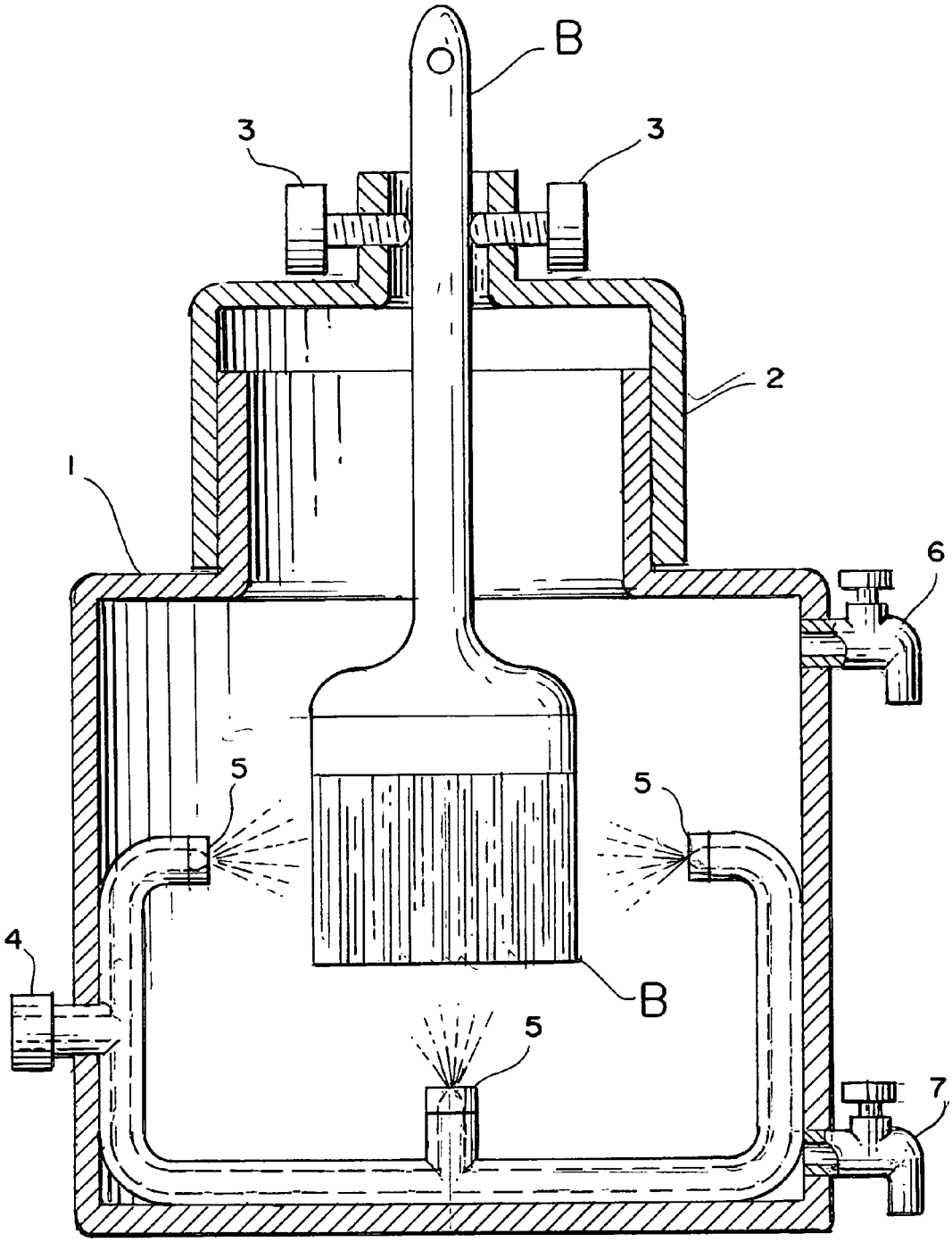
FIG. 1 shows the basic container in a cross section with a paint brush therein.
Figure 2:
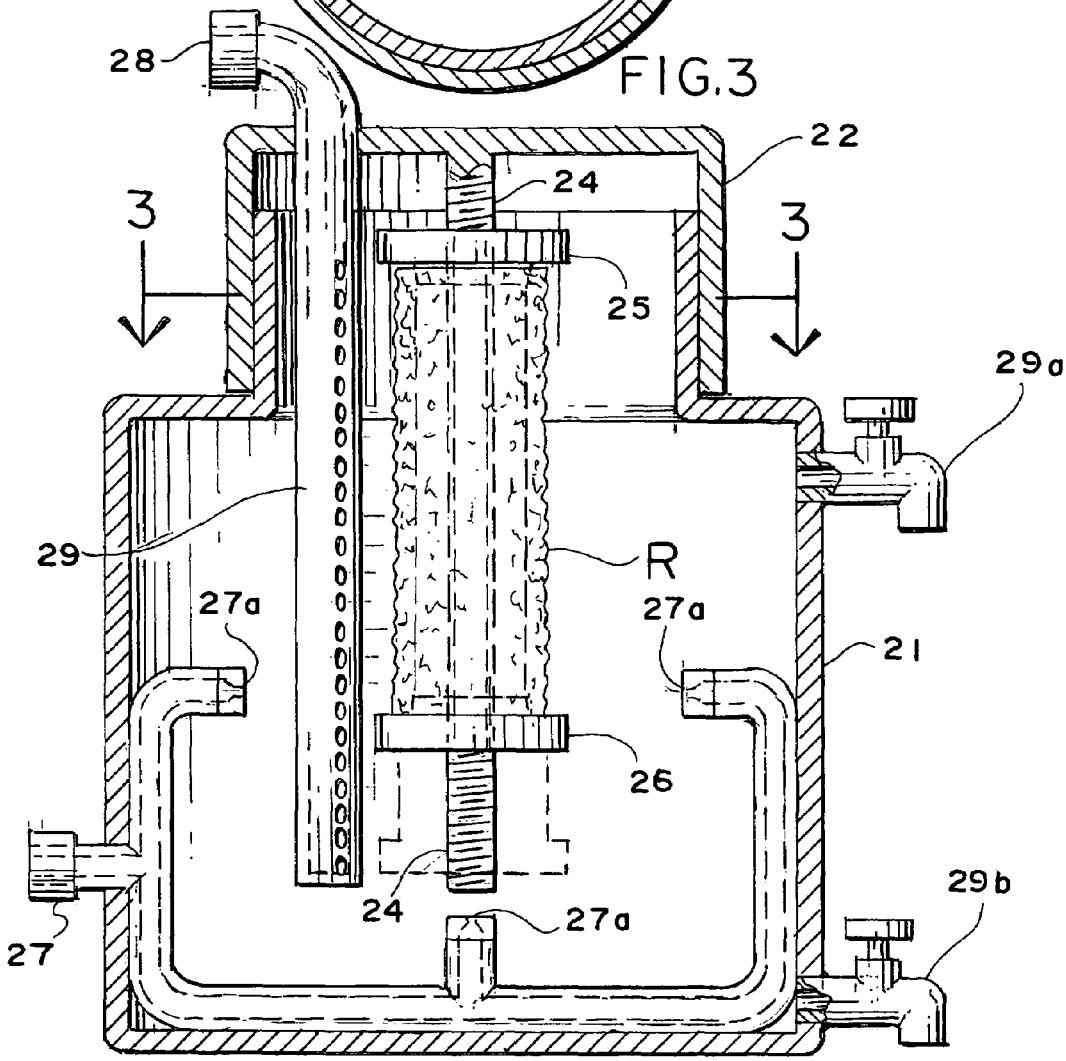
FIG. 2 is the same cross section of FIG. 1 with a paint roller therein.

FIG. 1 as well as FIG. 2 show the basic cleaning system in the cleaning of paint implements that involves a basic container 1 which may be of circular cross section. The basic container 1 is covered and closed off by a closure cap 2. Returning to the basic container 1, there are at least three spray nozzles 5 located in the basic container at various locations. There are shown at least two shown to be located diametrically located from each other about midway in the container 1. There is shown another spray nozzle 5 located at the center and the bottom of the container 1. There is also shown an overflow valve 6 at the top of the container 1 and a drain valve 7 located at the bottom of the container 1. As shown in FIG. 1, there is a paint loaded paint brush suspended in the top of the closure cap 2 by way of a screw 3 or any other way by way of a removable pin or a clamp. The container 1 has a pressure inlet of water shown at 4. All of the inlets and the pressure nozzle outlets can be controlled by way of controllable valves.

It can now be seen that the paint brush loaded with paint and being suspended from the closure cap 2 will be undergoing intense agitation by way of the at least three jet nozzles 5.

FIG. 2 illustrates the cleaning manner of cleaning a paint roller laden with paint. Again, there is shown a basic container 21 having a closure cap 22 thereon. Within and under the closure cap 2 there is located a threaded spindle 24 which will receive an upper bearing element 25 and then there is a lower counter bearing element 26 threadably received or installed on the threaded spindle 24. The bearing elements 24 and 25 are designed to receive a roller R there between so that the roller R can be rotated by tangential forces derived from the jet tube 29 having a pressure inlet at 28. The basic container still shows at least three pressure water jets 27*a* and a bottom drain outlet at 27. There is also an over flow outlet shown at 29*a*. The main water pressure for the jet tube 29 is shown at 28.

Figure 3:
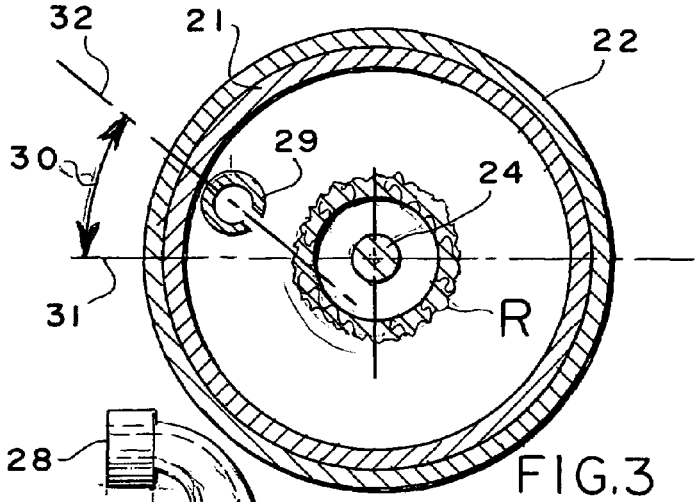
FIG. 3 is a top view of the cleaning action involving the paint roller.

FIG. 3 is a top view of the cleaning system of FIGS. 1 and 2. The paint loaded roller R is shown as being suspended on the threaded spindle 24. Adjacent to the roller R is located the jet tube 29 which is angled relative to the outer circumference of the roller R by the angle 30 defined by the lines 31 and 32. This way the jet stream emanating from the nozzles on the tube 29 will impinge upon the circumference of the roller R to create a force which will rotate the roller R into a spinning motion while it is being cleaned.

It can now be seen that the paint roller cleaning device of FIGS. 2 and 3 do a commendable job of cleaning paint rollers that can be used immediately after cleaning to accommodate different paint jobs in different colors.

What I claim is:

1. A paint laden implements cleaning system including a base container having a closure cap on top, said container having at least three water jet inlets located at various locations, one of said locations is a bottom center location and at least two other locations are located midway in said container and directed inwardly, means for suspending at least one of said implements from said closure cap and means for activating said nozzles to agitate said at least one of said pain laden implements with jet streams of water, wherein said means for suspending another one of said implements of said at least one of said paint implements is a threaded spindle depending from said closure cap which suspends a paint laden paint roller.

2. The cleaning system of claim 1, wherein said paint roller is rotatably supported on said spindle.

3. The cleaning system of claim 2, wherein said means for rotatably supporting is a first upper bearing threadably engaged with said spindle and a second lower bearing threadably engaged with said spindle, said paint roller is located between said first and said second bearings to be rotably between said first and said second bearings, whereby said threaded spindle can accommodate different lengths paint rollers.

4. The cleaning system of claim 2 including means for rotating said paint roller.

5. The cleaning system of claim 4, wherein said means for rotating said paint roller is a jet pipe suspended from said closure cap and adjacent to said paint roller, said jet pipe having a multiple of jet nozzles, said jet nozzles are arranged to emit water jet streams tangentially against an outer circumference of said paint roller to thereby rotate the same into a spinning motion including a water inlet at an upper end of said jet pipe in addition to a water pressure inlet at a bottom of said paint roller to interiorly pressurize said paint roller with a cleaning fluid.

6. The cleaning system of claim 1, including an overflow valve located in said basic container at an upper end thereof.

7. The cleaning system of claim 1 including a drainage plug located in said basic container at a bottom end thereof.

* * * * *